US009791126B2

(12) United States Patent
Goujon

(10) Patent No.: US 9,791,126 B2
(45) Date of Patent: Oct. 17, 2017

(54) SPHERICAL LIGHTING DEVICE

(71) Applicant: COMMISSARIAT A L'ENERGIE ATOMIQUE ET AUX ENERGIES ALTERNATIVES, Paris (FR)

(72) Inventor: Charles-Elie Goujon, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/107,780

(22) PCT Filed: Dec. 22, 2014

(86) PCT No.: PCT/EF2014/078964
§ 371 (c)(1),
(2) Date: Jun. 23, 2016

(87) PCT Pub. No.: WO2015/097136
PCT Pub. Date: Jul. 2, 2015

(65) Prior Publication Data

US 2016/0327240 A1 Nov. 10, 2016

(30) Foreign Application Priority Data

Dec. 26, 2013 (FR) ..... 13 63593

(51) Int. Cl.
*F21V 5/00* (2015.01)
*F21V 5/04* (2006.01)
(Continued)

(52) U.S. Cl.
CPC ..... *F21V 5/046* (2013.01); *F21S 8/03* (2013.01); *F21S 9/02* (2013.01); *F21V 3/02* (2013.01);
(Continued)

(58) Field of Classification Search
CPC . F21K 9/232; F21K 9/235; F21V 3/00; F21V 3/02; F21Y 2103/33
(Continued)

(56) References Cited

U.S. PATENT DOCUMENTS 6,759,803 B2 * 7/2004 Sorg ..... H01L 33/486 257/E33.073
8,322,896 B2 12/2012 Falicoff et al.
(Continued)

FOREIGN PATENT DOCUMENTS

DE 10 2010 014 520 A1 10/2011
JP 2009-295299 A 12/2009
WO 2013/009728 A2 1/2013

OTHER PUBLICATIONS

International Search Report dated Apr. 8, 2015 in PCT/EP2014/078964 Filed Dec. 22, 2014.
French Search Report dated Sep. 4, 2014 in FR 13 63593 Filed Dec. 26, 2013.

*Primary Examiner* — William Carter
(74) *Attorney, Agent, or Firm* — Oblon, McClelland, Maier & Neustadt, L.L.P.

(57) ABSTRACT

A lighting device including: a source emitting a light cone; an electronic control circuit; a wall defining an enclosure including a first area through which the light cone passes, and a second area complementary to the first area; and a diffuser directing part of the light by backscattering towards the second area. The diffuser includes a first part oriented perpendicular to the axis of revolution of the light cone and forming a first divergent lens, and a second part forming a second divergent lens having a shape of a flared truncated cone with its axis of revolution parallel to the axis of revolution of the light cone, in which a larger diameter end is closest to the light source and a smaller diameter end is adjacent to the first part and surrounds the first part.

16 Claims, 4 Drawing Sheets

(51) Int. Cl.

| | |
|---|---|
| ***F21S 8/00*** | (2006.01) |
| ***F21S 9/02*** | (2006.01) |
| ***F21V 3/02*** | (2006.01) |
| ***F21V 3/04*** | (2006.01) |
| ***F21V 7/22*** | (2006.01) |
| ***F21V 23/00*** | (2015.01) |
| *F21Y 115/10* | (2016.01) |

(52) U.S. Cl.
CPC ..... *F21V 3/0427* (2013.01); *F21V 3/0445* (2013.01); *F21V 7/22* (2013.01); *F21V 23/009* (2013.01); *F21Y 2115/10* (2016.08)

(58) Field of Classification Search
USPC ..... 362/363, 331, 311.06
See application file for complete search history.

(56) References Cited

U.S. PATENT DOCUMENTS

| | | | | |
|---|---|---|---|---|
| 8,395,310 | B2 | 3/2013 | Li | |
| 8,506,103 | B2 | 8/2013 | Iimura et al. | |
| 9,004,724 | B2 * | 4/2015 | Gao | F21V 3/00 362/310 |
| 2010/0195335 | A1 * | 8/2010 | Allen | F21V 5/048 362/309 |
| 2011/0080740 | A1 * | 4/2011 | Allen | F21V 3/00 362/311.02 |
| 2011/0096552 | A1 | 4/2011 | Falicoff et al. | |
| 2012/0293062 | A1 | 11/2012 | Pickard | |
| 2013/0119866 | A1 | 5/2013 | Matsuda et al. | |

* cited by examiner

Fig. 5
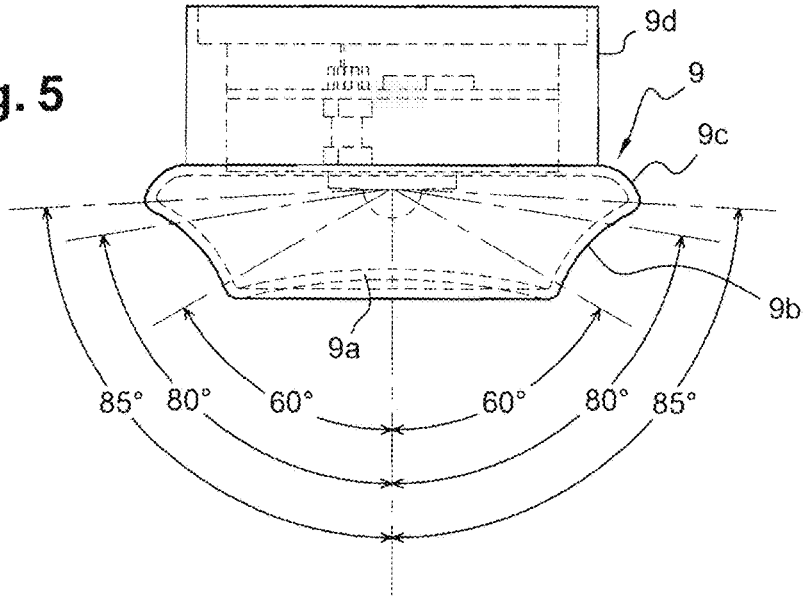
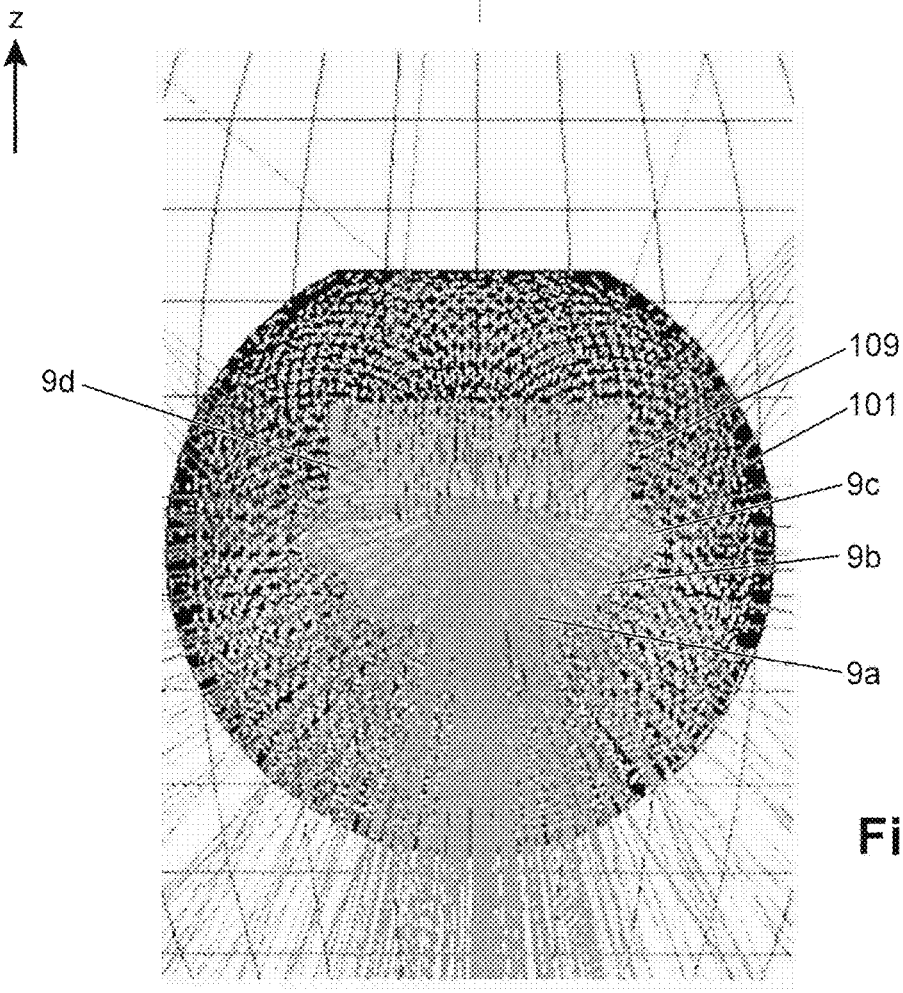
Fig. 6

SPHERICAL LIGHTING DEVICE

TECHNICAL FIELD

This invention relates to a lighting device comprising a spherical shaped object called a sphere or a globe, inside which there is a light source.

STATE OF PRIOR ART

One solution for achieving uniform lighting of a globe is to have multiple light sources inside the globe.

One difficulty lies in the fact that steps have to be taken to assure that each light source has the same lighting characteristics. It is particularly important to precisely control the colour temperature of each light source.

Another difficulty is related to the required precise positioning of light sources relative to each other. Emission cones of different light sources have to placed adjacent to each other with high precision so as to not create relatively dark or brighter areas on the globe.

Furthermore, so-called kinetic light structures have recently been developed comprising a large number of light spheres, typically tens to hundreds, free to move relative to each other, and that can be animated to form decorative patterns. This is only possible with light spheres with a diameter that does not exceed 10 or even 15 cm.

Each sphere has an electronic control module to control (and particularly modulate) lighting, so as to limit wired connections. But this module is bulky, and its presence will generate unwanted shadows if special precautions are not taken. Therefore, the brightness of the surface of the sphere is no longer uniform.

This raises the problem of creating a compact lighting device comprising a globe illuminated by a light source located inside the globe, in which the globe provides uniform lighting.

PRESENTATION OF THE INVENTION

The main purpose of this invention is to solve these problems.

This invention relates to a lighting device comprising a light source inside a globe.

One purpose of this invention is to obtain uniform illumination of the globe so that the globe or the light sphere can be treated like an elementary light point or "pixel."

Uniform lighting of the globe means particularly lighting with uniform brightness and colour.

The inventor discloses how a globe with uniform brightness can be obtained using a diffuser located inside the globe at least around the light source and using a globe comprising a material capable of diffusing light on the surface and the thickness of the globe.

This invention relates to a lighting device comprising at least:

- a light source, capable of emitting light as a light cone;
- a control circuit to control the light source,
- a wall with a shape that defines an enclosure surrounding the light source and the control circuit, said wall including a first wall area corresponding to the intersection of the wall and the light cone, and a second wall area complementary to said first wall area;
- the control circuit being located in a $1^{st}$ part of the enclosure, the light cone being emitted by the light source to a $2^{nd}$ part of the enclosure,

- a diffuser comprising a material diffusing light placed inside the enclosure between the light source and said first area, the diffuser being designed to direct part of the light by backscattering towards said second area of the enclosure surface.

The $1^{st}$ part is for example a so-called upper part of the enclosure.

The $2^{nd}$ part is different from the $1^{st}$ part. For example, the $2^{nd}$ part is a part of the enclosure called the lower part.

The diffuser may comprise material with a diffusion coefficient between 10 and 100 $cm^{-1}$, and preferably between 40 and 90 $cm^{-1}$.

The enclosure may comprise a transparent or translucent material. In particular, the material from which the enclosure is made may be diffusing, its diffusion coefficient being between 0.1 and 100 $cm^{-1}$, preferably between 0.1 and 10 $cm^{-1}$.

According to one particular embodiment, the enclosure may be in the shape of a globe, or a portion of a globe.

One advantage of a lighting device of the type described above lies in the fact that it can provide uniform lighting of the enclosure with a single light source despite the presence of the control circuit that produces a shadow zone when it is positioned in the first part of the enclosure. This uniform lighting is obtained by the backscattering of a part of the light emitted by the light source, by the diffuser.

According to one embodiment of this invention, the diffuser comprises:

- a first part oriented perpendicular to the axis of revolution of the light cone; this first part may form a $1^{st}$ divergent lens;
- a second optional part having the shape of a flared truncated cone with its axis of revolution parallel to the axis of revolution of the light cone, the larger diameter end being closest to the light source and the smaller diameter end being adjacent to the first part and surrounds the first part. This second part may form a $2^{nd}$ divergent lens.

Thus, a lighting device is disclosed comprising:

- a light source, capable of emitting a light cone;
- an electronic circuit to control the light source;
- a wall with a shape that defines an enclosure surrounding said light source and the electronic circuit, said wall comprising at least a first area corresponding to the intersection with the light cone, and a second area complementary to the first area;
- a diffuser located inside the enclosure between the light source and said first area, comprising a material that diffuses light, the diffuser being capable of directing a portion of the light towards said second area, by backscattering;

in which the electronic circuit is located in a first part called the top part of the enclosure, the light cone being emitted from the light source to a second part, called the bottom part of the enclosure;

and in which the diffuser comprises a first part oriented perpendicular to the axis of revolution of the light cone and forming a first divergent lens, and a second part forming a second divergent lens, the second part being in the form of a flared truncated cone of which the axis of revolution is parallel to the axis of revolution of the light cone, and of which the larger diameter end is closest to the light source and the smaller diameter end is adjacent to the first part and surrounds the first part.

The radius of curvature of the second divergent lens may be less than the radius of curvature of the first divergent lens.

According to one embodiment of the present invention, the diffuser also comprises a third part forming a third convergent lens, the third part being in the form of a flared truncated cone of which the axis of revolution is parallel to the axis of revolution of the light cone and the larger diameter end is adjacent to the second part.

According to one embodiment of this invention, the diffuser is arranged such that the light cone of the light source is directed toward the first and second parts of the diffuser.

The control circuit is for example designed to remotely control the light intensity and the colour temperature. Advantageously, the control circuit integrated inside the globe has at least one battery. One purpose of the present invention is to integrate most electronic components required for operation of the device inside the globe itself, so that these elements cannot be perceived from the outside. The control circuit is located outside the light cone.

According to one embodiment of the present invention, the diffuser also comprises a fourth part surrounding the control circuit and providing mechanical support for the control circuit in the globe.

According to one embodiment of this invention, the control circuit comprises at least one electronic board acting as a support for the light source.

According to one embodiment of this invention, the control circuit comprises at least one battery and a charging circuit for the at least one battery by inductive coupling.

One advantage of a lighting device of the type described above lies in the possibility of integrating most electronic components required for operation of the device inside the globe itself, without these elements being perceived from the outside.

This make the lighting device compact and improves its visual appearance. This also makes it possible to include large electronic components such as batteries inside the globe, to make a self-contained lighting device.

In addition, by including a battery and an inductively coupled battery charging circuit inside the globe, the battery of the lighting device can be recharged without wire connection, by placing the lighting device close to or in contact with a special purpose support. The result obtained is a wireless lighting device.

According to one embodiment of this invention, the light source is arranged at a height lower than a median plane of the globe.

The globe may comprise low density polyethylene. According to one alternative, the globe may comprise glass.

The globe may be between 100 μm and 1 cm thick.

The diffuser may comprise polyvinyl chloride.

The light source may be a light emitting diode.

This invention also applies to a lighting system comprising a plurality of lighting devices of the type described above.

BRIEF DESCRIPTION OF THE DRAWINGS

FIG. 5 illustrates the role of different parts of the diffuser in FIG. 3.

FIG. 6 illustrates the results of modelling the distribution of light energy in the lighting device in FIG. 1.

DETAILED PRESENTATION OF PARTICULAR EMBODIMENTS

Figure 1:
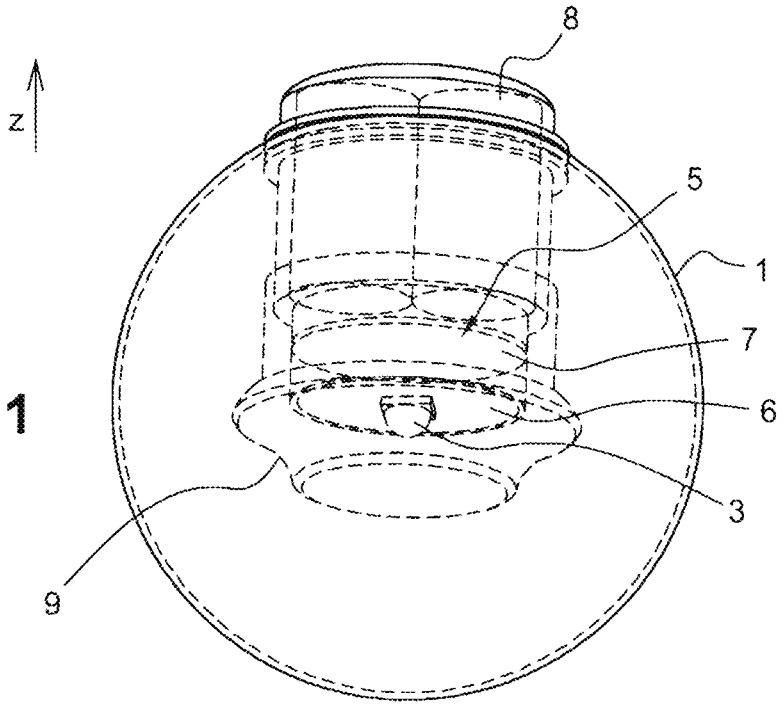
FIG. 1 is a sectional and perspective view diagrammatically showing a lighting device.

FIG. 1 is a sectional and perspective view diagrammatically showing a lighting device.

The lighting device comprises a wall 1 forming an enclosure surrounding the light source and the electronic control circuit.

The shape of the enclosure may be spherical, and may form a globe inside which the light source is located. The invention is not limited to a globe-shaped enclosure, since its shape can be cubic, ovoid, or drop-shaped. An approximately spherical shape is preferred.

The light source defines a $1^{st}$ part, herein referred to the upper part of the enclosure containing the electronic circuit, and a $2^{nd}$ part, herein referred to as the lower part of the enclosure containing the emission cone. In particular, the electronic circuit is arranged between the light source and the wall of the enclosure, opposite the light emission cone.

A light source 3 for emitting light as a light cone, is located inside the globe-shaped enclosure 1 in the example illustrated. The light source 3 may for example be a light emitting diode (LED), for example an RGBW (red, green, blue, white) type power LED.

A control circuit 5 of the light source 3 is also located inside the globe 1.

The control circuit 5 includes for example electronic boards. In the example shown in FIG. 1, an electronic board designated reference 6 acts as a support for the light source 3. The electronic board 6 also contains components for implementing the main functions of the control circuit. For example, the electronic board 6 comprises a radiofrequency module and/or a LED driver and/or an accelerometer and/or a microcontroller. Another electronic board designated reference 7 includes, for example, a ceramic antenna.

The control circuit 5 enables remote control of the intensity and colour of light emitted by the light source 3. In particular, the control circuit 5 may include a microprocessor storing a lighting sequence of the light source. The term lighting sequence means a time period during which the intensity of the source is modulated automatically.

Advantageously, the control circuit 5 also includes at least one battery 8 for operation of the electronic boards and to store energy so as to obtain a self-contained wireless lighting device. As shown in FIG. 1, the batteries 8 are large in comparison with other components of the control circuit 5 inside the globe 1.

As an example of the order of magnitude of the dimensions, the diameter of the globe 1 may be about 80 mm. The control circuit 5 may be cylindrical in shape, and for example its diameter may be about 36 mm and its height about 40 mm. This represents a volume of about 41 $cm^3$ for the control circuit 5 and about 260 $cm^3$ for the volume delimited by the enclosure 1. Thus, in general, the electronic circuit can occupy at least one-tenth of the internal volume of the enclosure. The enclosure is then divided into an upper part comprising the electronic circuit, and a lower part comprising the emission cone emitted by the light source 3.

The light source 3 is for example centred in the globe 1.

In the example illustrated in FIG. 1, the circuit board 6 acting as support for the light source 3 is for example arranged perpendicular to the z axis. The z axis may for example be a vertical axis.

In this description, the terms "upper/lower", "up/down" and "above/below" should be understood as relating to the orientation and direction of the z axis and with respect to a plane of symmetry of the globe perpendicular to the z axis (or median plane).

The light source 3 could possible be positioned at a height lower than the plane o symmetry of the globe perpendicular to the z axis.

In the example illustrated in FIG. 1, the circuit board 6 is positioned in the globe 1 such that the light source 3 emits light downwards. Light emitted by the light source 3 is directed towards the bottom of the globe 1. The control circuit 5 is located above the light source 3, outside the light cone emitted by the light source.

The inventor discloses how a diffuser can be placed inside the globe, particularly in the emission cone of the light source, so as to obtain a globe that provides uniform illumination when the light source emits light. The function of this diffuser made from a diffusing material is to back scatter part of the light emitted by the source in the emission cone, towards parts of the enclosure not directly illuminated by the source.

The term backscatter means that at least 20% of light emitted by the source in the light cone is reflected.

Furthermore, the term light cone means the volume in which the light intensity emitted by the source at a given distance from the source is greater than 20% of the maximum intensity.

Uniform lighting of the globe means lighting with uniform light intensity. A "material diffusing" light means a material with a low diffusion coefficient, for example between 10 and 100 $cm^{-1}$, and preferably between 40 and 90 $cm^{-1}$. When this diffusion coefficient is too low, and particularly lower than the lower limits specified above, the diffuser does not enable sufficient backscattering. When the diffusion coefficient is too high, and particularly higher than the upper limits specified above, backscattering is excessive.

The material using for the globe 1 that diffuses light can be chosen to be a material that diffuses light, for example a thermoplastic polymer, for example a low density polyethylene (LDPE). A globe made of such a material can also be sufficiently opaque while being partially transparent to light emitted by the light source 3.

According to one alternative, the globe 1 may be translucent or transparent, for example comprising glass.

The globe 1 is in the form of a thin spherical wall, for example between about 100 μm and about 1 cm thick.

When the globe is translucent, it preferably comprises a material with a diffusion coefficient of less than 10 $cm^{-1}$. A diffuser 9 is placed inside the globe 1, at least around the light source 3. The diffuser 9 will back scatter a part of the light emitted by the light source 3.

In the example illustrated in FIG. 1, the diffuser 9 surrounds the light source 3 and the control circuit 5, comprising electronic boards 6 and 7 and batteries 8.

Figure 2:
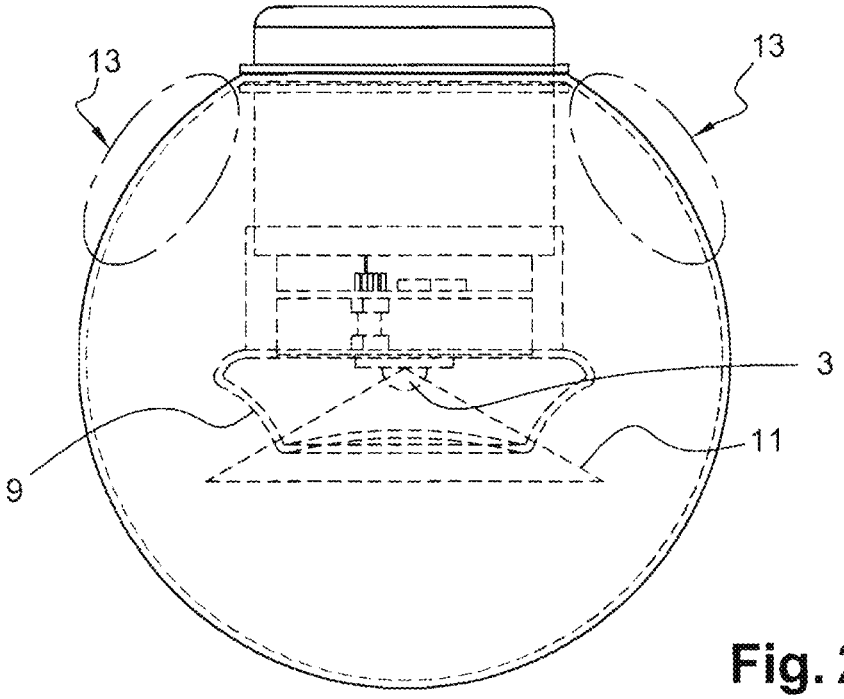
FIG. 2 is a sectional view corresponding to FIG. 1, diagrammatically illustrating the light cone emitted by the light source and the critical areas of the globe to be illuminated.

FIG. 2 is a sectional view corresponding to FIG. 1.

A main part of the light cone 11 emitted by the light source 3 is diagrammatically illustrated by a triangle 11. The areas of the globe 1 surrounded by and designated as reference 13 are critical areas of the globe 1 that have to be illuminated to obtain uniform lighting of the globe. These critical areas can include shadowed areas due to the presence of the control circuit 5 located in the upper part of the globe.

The diffuser 9 is intended to deflect part of the light rays in the light cone emitted upwards by the light source 3, above the light source 3, by backscattering so as to light the upper part of the globe 1 and particularly the critical areas 13.

Figure 3:
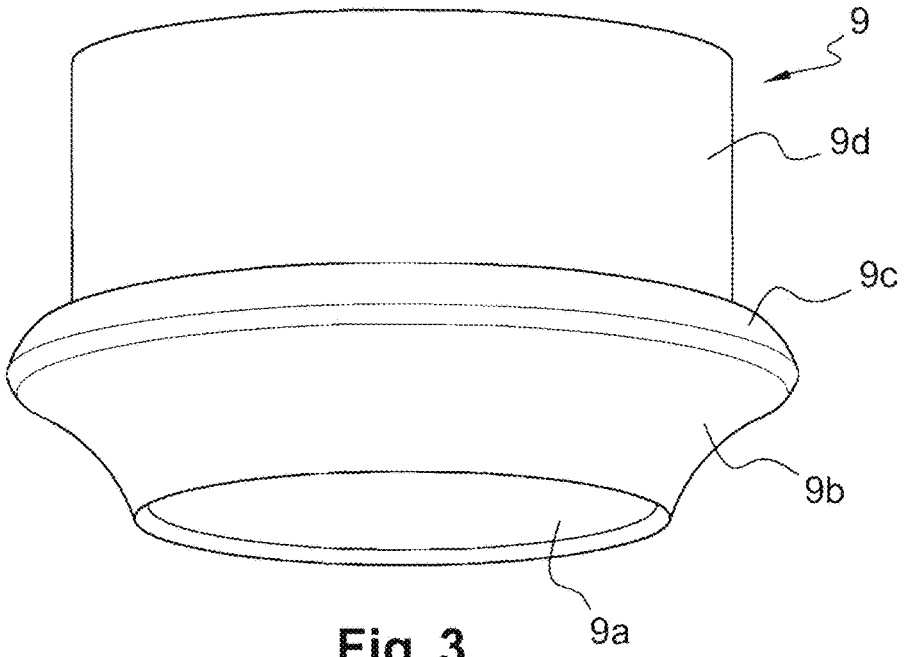
FIG. 3 is a diagrammatic perspective view showing a diffuser for use in the lighting device in FIG. 1.

FIG. 3 is a perspective view diagrammatically showing an example of a diffuser 9 that can be used in a lighting device of the type described with reference to FIG. 1.

The diffuser 9 comprises at least one part designated as reference 9*a*, and optional parts 9*b*, 9*c* and 9*d*. The first part 9*a* and the possible second part 9*b* intersect the light cone between the source and the enclosure 1.

The diffuser 9 is intended to surround at least the light source 3 and possibly the control circuit 5.

The diffuser 9 comprises a material that is at least partly transparent to light radiation emitted by the light source 3. The diffuser 9 may for example be made from a thermoplastic polymer, for example polyvinyl chloride (PVC).

A first portion of the diffuser 9, designated as reference 9*a*, will face the light source 3. The part 9*a* extends with its surface approximately perpendicular to the axis of revolution of the light cone emitted by the light source 3 (or the main direction of light emission). The part 9*a* is preferably convex in shape as seen from the inside of the diffuser 9. The part 9*a* then forms a diverging lens. Alternately, the portion 9*a* is plane, for example in the shape of a flat disk, however the convex shape is preferred.

A second optional portion of the diffuser 9 is designated as reference 9*b* and extends as a "flared" truncated cone, preferably convex in shape as seen from inside the diffuser 9, the axis of revolution of which is approximately parallel to the main direction of emitted light. The truncated cone is said to be flared because its surface is not flat. The larger diameter end of the flared truncated cone is the end closest to the light source 3 and the smaller diameter end is adjacent to the first part 9*a* and surrounds the first part 9*a*. Part 9*b* forms a divergent lens like part 9*a*, but is annular in shape. Alternatively, the portion 9*b* can be conical, and the side of the cone is not flared.

A third optional part of the diffuser 9, designated as reference 9*c*, will also surround the light source 3 laterally. The part 9*c* is in the form of a truncated cone, preferably flared, concave as seen from inside the diffuser 9, the axis of revolution of which is approximately parallel to the principal direction of light emission. The larger diameter end of the flared truncated cone is adjacent to part 9*b*. The third part 9*c* does not intersect the emission cone of the source. Part 9*c* forms an annular-shaped convergent lens.

Preferably, the diffuser 9 is positioned inside the globe 1 such that part of the light emitted by the light source 3 is directed towards the first and second parts 9*a*, 9*b* of the diffuser 9. In other words, the light cone intersects said portions 9*a* and 9*b*.

In the example illustrated in FIG. 1, the diffuser 9 is positioned so that the smaller diameter end of part 9*c* surrounds the support of the light source 3.

A fourth optional part of the diffuser 9, designated as reference 9*d*, will surround the control circuit 5. The fourth part 9*d* of the diffuser 9 mechanically retains the control circuit 5 inside the globe 1.

In the example illustrated in FIGS. 1 and 3, the part 9*d* is in the form of a cylinder of revolution the axis of revolution of which is oriented approximately parallel to the principal direction of light emission.

Figure 4:
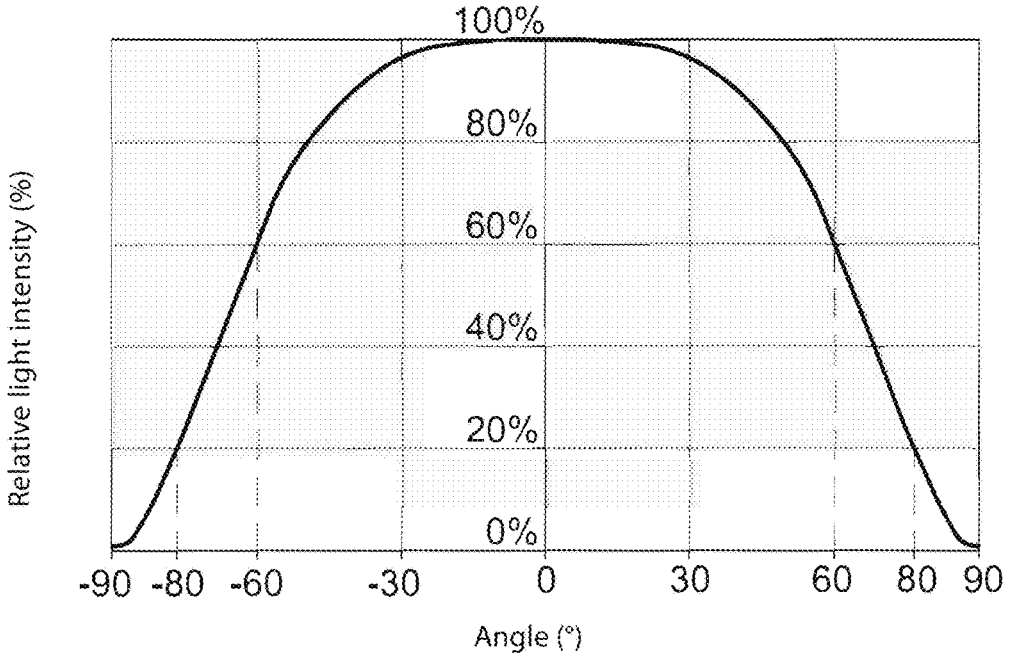
FIG. 4 shows an emission diagram of a light emitting diode.

The shape and dimensions of the example diffuser shown in FIG. 3 were selected for a lighting device comprising a light source 3 having an emission diagram of the type illustrated in FIG. 4.

FIG. 4 illustrates an emission pattern of a LED, showing the relative light intensity as a function of the angle of a light ray in the light cone emitted by the LED (or emission cone). The value of the angle is calculated relative to the axis of revolution of the light cone or the main direction of the light emission. In the case of the lighting device illustrated in FIG. 1, the axis of revolution of the light cone emitted by the LED corresponds to the z axis. This diagram represents the angular distribution of light energy provided by the LED.

The emission diagram in FIG. 4 corresponds to a RGBW LED of the Xlamp mc-e color type marketed by CREE.

The light intensity is maximum for a ray oriented along the axis of revolution of the emission cone and decreases when the angle of inclination of the rays increases relative to the axis of revolution of the emission cone, A central portion of the emission cone corresponding to rays with an angle of between 0° and 60° (absolute value), corresponds to a relative light intensity between about 100% and 60%.

A peripheral portion of the emission cone corresponding to the rays at an angle of between 60° and about 80° (absolute value), corresponds to a relative light intensity between about 60% and 20%.

Rays with an angle of between about 80° and 85° (absolute value), correspond to a relative light intensity between about 20% and 5% and are not considered to be part of the light cone in the meaning of the invention.

A diffuser of the type shown in FIG. 3 enables a part of the energy of the emission cone to be used to light the upper area of the globe.

FIG. 5 illustrates the role of the different parts of the diffuser in FIG. 3 for a LED with an emission diagram of the type shown in FIG. 4.

Part 9*a* of the diffuser 9 is designed to intercept a large proportion of the rays in the central portion of the emission cone (angles between about 0° and 60°). The diffuser 9 comprises of a material that is at least partly transparent to light radiation emitted by the light source 3, part of the light energy is diffused by the part 9*a* to a lower portion of the globe.

Part 9*a* of the diffuser 9 enables to reduce the light power received directly by the globe, in a first area of the surface of the globe corresponding to the intersection of the light cone and the globe, while backscattering part of the light power to a second area of the surface of the globe complementary to the first area.

Part 9*b* of the diffuser 9 is designed to intercept rays from the peripheral portion of the emission cone (angles between 60° and about 80°). An upper portion of the part 9*b* also intercepts a part of the rays at the edge of the emission cone (angles between about 80° and 85°). The shape of the truncated cone of part 9*b* is such that a peripheral portion of the emission cone is intercepted while maintaining a high light power in the main direction of light emission. Part 9*b*, forming a diverging lens like part 9*a*, widens the emission cone by intercepting part of the light rays and deflecting towards said second area of the globe surface.

Part 9*b* of the diffuser 9 also receives additional light energy from backscattering on the inner surfaces of the diffuser 9, from light rays deviated by the portion 9*a*. This makes it possible to redirect reflected rays towards the upper part of the globe, above the light source.

Part 9*b* receives less light energy than part 9*a*. For this reason, the radius of curvature of part 9*b* is preferably less than that of part 9*a*.

Unlike parts 9*a* and 9*b* of the diffuser 9 that are designed to backscatter light emitted by the light source, the part 9*c* of the diffuser 9 forming a converging lens is intended to capture and focus the light rays. Part 9*c* makes it possible to converge part of the light rays towards the upper area of the globe to illuminate this area of the globe.

The lower portion of part 9*c* of the diffuser intercepts a negligible part of the emission cone. This part 9*c* collects essentially radiation backscattered by parts 9*a* and 9*b* of the diffuser to make their distribution uniform in the upper part of the globe.

The diffuser 9 enables to direct part of the light cone emitted by the light source to the second area on the surface of the globe (complementary to the first intersection area of the light cone and the globe). The material from which the globe 1 is made makes it possible to create uniform lighting over the entire surface of the globe, in the first and second areas.

Advantageously, the support of the light source can be at least partly covered by a white coating, for example a white varnish. This maximizes the internal reflection of light rays in the diffuser 9, and therefore maximizes the light energy emitted by the lighting device.

As an example of the order of magnitude of dimensions for the different parts of the diffuser 9, for an RGBW type power LED with an emission diagram of the type shown in FIG. 4 and a globe 1 diameter of about 80 mm:

- part 9*a* corresponding to a divergent lens has a radius of curvature for example of the order of 55 mm;
- part 9*a* corresponding to a divergent lens has a radius of curvature for example of the order of 13 mm; and
- part 9*c* corresponding to a convergent lens has a radius of curvature for example of the order of 4 mm.

The skilled person will know how to change the shape and dimensions of the diffuser 9 as a function of the chosen light source, such as another type of light emitting diode. In particular, the skilled person will use the emission diagram of the chosen light source.

According to one variant of the diffuser shown in FIG. 3, the diffuser 9 may include parts 9*a* and 9*b*, but not parts 9*c* and 9*d*.

According to another alternative, the different parts of the diffuser 9 may be facetted to improve redistribution of light rays to different areas of the globe.

The inventor has made models that illustrate the role of the diffuser 9 in alighting device of the type described with reference to FIG. 1.

FIG. 6 shows a calculated distribution of light energy, in a plane of symmetry of the globe parallel to the z axis (corresponding to the sectional plane in FIG. 2).

The calculations were performed for a lighting device comprising a globe 101, a circuit board located inside the globe acting as a support for a LED, and a diffuser 109 of the type illustrated in FIG. 3, surrounding the LED and the electronic board. The main direction of light emission of the LED is along the z axis. The LED emits light downwards.

These results show that high energy light located in the central portion of the emission cone of the LED is directed towards a lower portion of the globe. This light energy is diffracted by part 9*a* of the diffuser 109.

These results also show that the diffuser 109 widens the emission cone and directs light rays towards the upper part of the globe 101, above the light source. In particular, these results show that the diffuser 109 can illuminate critical areas 13 of the globe highlighted in FIG. 2.

The globe itself, due to the choice of a material that diffuses light, makes lighting of the globe uniform (the material specifically chosen for the globe was not taken into account in the model).

Figure 7A:
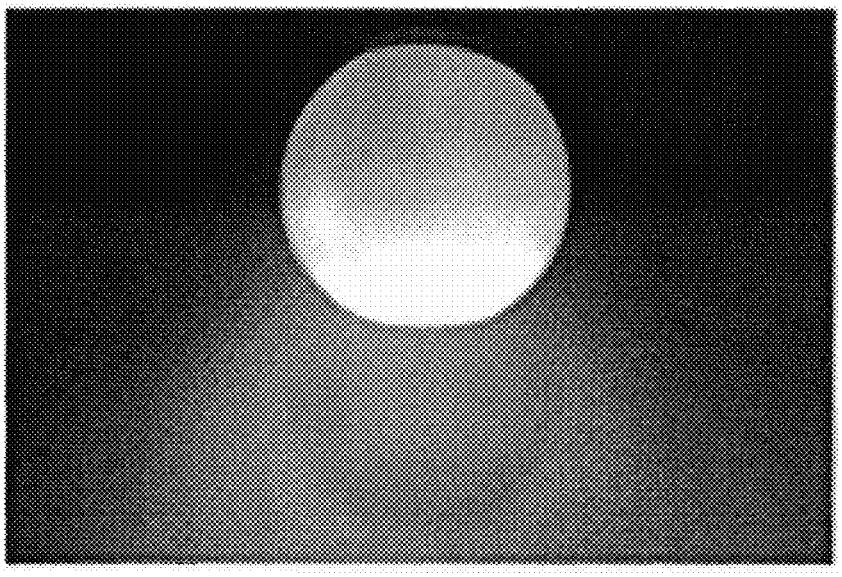
FIGS. 7A and 7B are photographs illustrating the performances of the lighting device in FIG. 1, without and with the diffuser in FIG. 3 respectively.
Figure 7B:
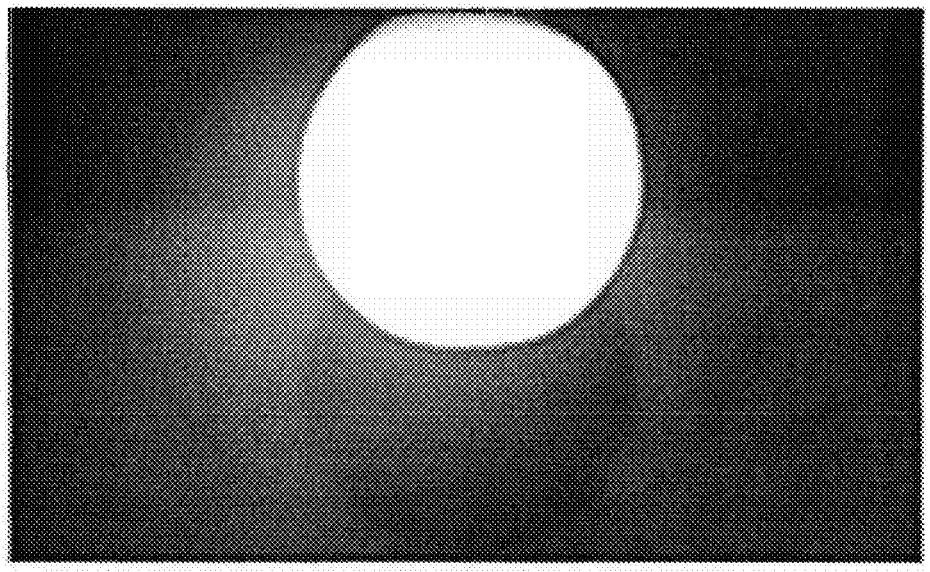

FIGS. 7A and 7B are photographs illustrating the performances of a lighting device of the type illustrated in FIG. 1, without a diffuser and a with a diffuser of the type shown in FIG. 3 respectively.

FIG. 7A (without a diffuser), clearly shows that a lower part of the globe is brightly lit, then the remainder of the globe is only lit dimly. It can also be seen that the light halos generated by the globe are cone-shaped facing downwards.

FIG. 7B (with diffuser and under the same conditions) shows that the globe is almost entirely illuminated. The globe is also illuminated uniformly. We can also see that light halos generated by the globe are approximately spherical in shape and surround the globe.

One advantage of a lighting device of the type described with reference to FIG. 1 lies in the fact that it can provide uniform lighting of the globe.

Another advantage of such a lighting device is related to the fact that the diffuser forms a resonant cage for light rays. This maximizes light energy emitted by the illumination device.

Another advantage of such a lighting device is related to the fact that the diffuser is used to position and hold the components of the control circuit in position in the globe.

Another advantage of such a lighting device lies in the possibility of integrating most electronic components required for the operation of the device inside the globe itself, without these elements being perceived from the outside.

This results in a compact lighting device with an improved visual appearance. This also makes it possible to install electronic components such as batteries inside the globe to make a self-contained lighting device.

In addition, by arranging a battery and a inductively coupled battery charging circuit inside the globe, the battery of the lighting device can be recharged without any wire connection by placing the lighting device close to or in contact with a special purpose support. A wireless lighting device is thus obtained.

Another advantage of a lighting device of the type described with reference to FIG. 1 lies in the fact that the use of a diffuser inside the globe makes it possible to use a single light source. This facilitates control of the light intensity and the lighting colour of the globe.

The inventor also discloses how a lighting system can be made comprising a set of lighting devices (or globes or light spheres) like that described with reference to FIG. 1.

Such a lighting system comprises for example at least 1000 globes or light spheres, for example arranged in a matrix of 32 rows and 32 columns. The light spheres may be connected by wires to a ceiling light.

Such a lighting system makes it possible to control the movement (for example vertical), the light intensity and/or the colour of each light sphere "pixel") independently of other light spheres.

The invention claimed is:

1. A lighting device comprising:

a light source configured to emit light as a light cone;

an electronic circuit to control the light source;

a wall with a shape that defines an enclosure surrounding the light source and the electronic circuit, the wall including at least a first area corresponding to an intersection with the light cone, and a second area complementary to the first area;

a diffuser comprising a material diffusing light arranged inside the enclosure between the light source and the first area, the diffuser configured to direct part of the light by backscattering towards the second area;

wherein the electronic circuit is placed in a first part of the enclosure as an upper part, the light cone being emitted from the light source to a second part of the enclosure as a lower part; and wherein the diffuser comprises a first part oriented perpendicular to the axis of revolution of the light cone and forming a first divergent lens, and a second part forming a second divergent lens, the second part having a shape of a flared truncated cone with its axis of revolution parallel to the axis of revolution of the light cone, wherein a larger diameter end is closest to the light source and a smaller diameter end is adjacent to the first part and surrounds the first part.

2. The lighting device according to claim 1, wherein the diffuser comprises a material that is transparent or translucent to light emitted by the light source.

3. The lighting device according to claim 1, wherein the diffuser comprises a material with a reduced diffusion coefficient between 10 and 100 $cm^{-1}$.

4. The lighting device according to claim 1, wherein the diffuser comprises a material with a reduced diffusion coefficient between 40 $cm^{-1}$ and 90 $cm^{-1}$.

5. The lighting device according to claim 1, wherein the radius of curvature of the second divergent lens is less than the radius of curvature of the first divergent lens.

6. The lighting device according to claim 1, wherein the diffuser further comprises a third part forming a third convergent lens, the third part being in a form of a flared truncated cone of which the axis of revolution is parallel to the axis of revolution of the light cone and a larger diameter end is adjacent to the second part.

7. The lighting device according to claim 5, wherein the diffuser further comprises a fourth part surrounding the control circuit and providing mechanical support for the control circuit.

8. The lighting device according to claim 1, wherein the diffuser is configured such that light emitted by the light source is directed toward the first part and the second part of the diffuser.

9. The lighting device according to claim 1, wherein the control circuit is fixed to the light source.

10. The Lighting device according to claim 1, wherein the control circuit comprises at least one battery and an inductively coupled charging system for the at least one battery.

11. The lighting device according to claim 1, wherein the light source is located at a height lower than the median plane of the cone.

12. The lighting device according to claim 1, wherein the wall foiining the enclosure comprises a transparent or translucent material.

13. The lighting device according to claim 1, wherein the wall forming the enclosure comprises low density polyethylene or glass.

14. The lighting device according to claim 1, wherein the wall forming the enclosure is between 100 μm and 1 cm thick.

15. The lighting device according to claim 1, wherein the diffuser comprises polyvinyl chloride.

16. A lighting system comprising a set of lighting devices according to claim 1.

* * * * *